US005246563A

United States Patent [19]

Maresch et al.

[11] Patent Number: 5,246,563

[45] Date of Patent: Sep. 21, 1993

[54] PROCESS FOR THE ELECTROLYTIC ZINC COATING OF STAINLESS STEEL

[75] Inventors: Gerald Maresch, Mödling; Ulrich Krupicka, Vienna, both of Austria

[73] Assignee: Andritz-Patentverwaltungs-Gesellschaft m.b.H., Austria

[21] Appl. No.: 815,612

[22] Filed: Jan. 7, 1992

Related U.S. Application Data

[63] Continuation of Ser. No. 406,895, Sep. 13, 1989, abandoned.

[30] Foreign Application Priority Data

Sep. 14, 1988 [AT] Austria ..... 2257/88

[51] Int. Cl.[5] ..... C25D 7/06

[52] U.S. Cl. ..... 205/141; 205/227; 205/305

[58] Field of Search ..... 205/141, 155, 227, 305

[56] References Cited

U.S. PATENT DOCUMENTS

| | | | |
|---|---|---|---|
| 4,808,278 | 2/1989 | Roberts | 204/28 |
| 4,814,048 | 3/1989 | Suzuki | 204/28 |
| 4,969,980 | 11/1990 | Yoshioka | 204/28 |

FOREIGN PATENT DOCUMENTS

| | | |
|---|---|---|
| 269808 | 5/1988 | European Pat. Off. . |
| 63-192892 | 8/1988 | Japan . |

*Primary Examiner*—John Niebling
*Assistant Examiner*—William T. Leader
*Attorney, Agent, or Firm*—Keck, Mahin & Cate

[57] ABSTRACT

In a process for the electrolytic zinc coating of high-grade steel on one and two sides, the latter is connected as a cathode in the form of a high-grade steel strip in a galvanic cell, and metallic zinc is deposited on the high-grade steel strip from an aqueous solution of a zinc salt with a pH value of 1.0 to 2.5, preferably 1.5 to 2.0, as a result of which a contact corrosion with zinc-coated metal sheet is avoided, which is particularly important in the motor-car industry.

12 Claims, No Drawings

PROCESS FOR THE ELECTROLYTIC ZINC COATING OF STAINLESS STEEL

This application is a continuation of application Ser. No. 07/406,895, filed Sep. 13, 1989, now abandoned.

This invention relates to a process for the electrolytic zinc coating of stainless steel on one and two sides.

Processes for the electrolytic zinc coating of steel strips have been known for many years and have been described in detail in various embodiments in the literature.

Until now, however, only very little is known about the electrolytic zinc coating of stainless steel strips. The reason for this is that, as tests have shown, only a very narrow range of conditions is available in the case of processes of this type.

The term "high grade steel" comprises stainless steel from the series AISI 200, 300 and 400.

The processes which are usual for steel strips operate in a pH range of under 1 to approximately 4 at temperatures of 40° to 70° C. and current densities of up to 200 A/dm$^2$.This range must now be substantially restricted in the case of processes with stainless steel.

If acid concentrations with a pH value of under 1.5 are used, the stainless steel strip is attacked by the acid and consequently becomes matt, and pitting can be clearly seen with the aid of scanning electron microscope photographs. In the case of pH values of over 2.5, on the other hand, a very poor adhesion of the zinc to the stainless steel is obtained, and the coating can be removed like a foil. Furthermore, various alloying elements of the stainless steel additionally have the undesired characteristic of reducing the adhesion.

Finally, on account of the lower specific conductivity of the stainless steel, which amounts to only about a fifth of that of steel, there are limits on economic grounds to the current densities for deposition.

The object of the present invention is now to provide a process for the zinc coating of stainless steel, in particular for the motor-car industry, which will overcome the problems described above and will avoid the contact corrosion with zinc-coated metal sheet.

This object is attained according to the invention by a process of the type described above in that the stainless steel is connected as a cathode in the form of a stainless steel strip in a galvanic cell, and metallic zinc is deposited on the stainless steel strip from an aqueous solution of a zinc salt with a pH value of 1.0 to 2.5, preferably 1.5 to 2.0.

According to a further feature of the invention the coating takes place at a constant current density. This feature provides the advantage that the duration of the process can be substantially reduced, since a preliminary treatment at low current intensities is unnecessary. In addition, the size of the galvanic plant is also kept small, since the section for preliminary treatment is omitted.

The current densities in the case of the process according to the invention are between 25 and 200 A/dm$^2$, preferably between 50 and 150 A/dm$^2$, for coating on one side, and between 10 and 100 A/dm$^2$, preferably between 25 and 75 A/dm$^2$, for coating on both sides.

The zinc deposited from the solution is supplemented in a dissolving station with the use of metallic zinc or zinc oxide.

In accordance with a feature of the process according to the invention, the zinc salt can also be present as zinc sulphate, the concentration of dissolved zinc ions in the solution amounting to 20 to 150 g/l, preferably 100 to 130 g/l.

The temperature of the electrolyte amounts to 20 to 90° C., preferably 45° to 60° C.

Rising temperature values of the electrolyte, however, are also associated with an increased occurrence of pitting corrosion, in particular in the case of pH values which are close to the lower of the said range limits.

In accordance with a further feature of the process according to the invention, the anodes used are in the form of insoluble anodes which consist of lead, a lead alloy or titanium coated with noble metals.

The adhesive strength of the deposited zinc coating can be increased by a subsequent heat treatment, which is preferably carried out at a temperature of 100° to 400° C., in particular at 200° to 300° C., the stainless steel strip being heated by sources of heat, for example in a conventional infrared furnace, and kept at [the] temperature.

The time duration of the heat treatment is related to the temperature applied and is in the region of between 30 minutes, preferably at temperatures in the lower boundary range, and 1 minute, preferably in the upper boundary range of the treatment temperatures. The values for the duration of treatment, however, can fluctuate within the values indicated depending upon the parameters selected in the case of the electrolytic zinc coating.

Further details and advantages of the present process according to the invention are described below with reference to examples of application:

EXAMPLE 1

A cold strip of stainless ferrite steel from a bright-annealing plant was first degreased and cleaned on both sides, then pickled on the side to be coated, rinsed and inserted in an electrolyte zinc-coating plant which operates with cells of a Gravitel system. Insoluble precious metal anodes on a titanium carrier material were used as anodes for the coating, [and] the electrolyte was an aqueous zinc sulphate solution, the concentration of dissolved zinc ions in the solution amounting to 125 g/l. With a current density of 70 A/dm$^2$, an electrolyte temperature of 60° C. and a pH value of the electrolyte of 1.2 the stainless steel strip was coated on one side with a zinc layer of 15 μm in thickness. A subsequent analysis of the material produced showed an excellent adhesion of the zinc layer to the carrier material, whereas slight pitting occurred on the rear.

EXAMPLE 2

A cold strip of stainless ferrite steel was treated as in Example 1, and was coated under conditions which were identical down to the electrolyte temperatures. The said temperature of the zinc electrolyte was lowered this time to 50° C. An excellent adhesion of the zinc layer was likewise found; the pitting was now no longer so pronounced.

EXAMPLE 3

With conditions otherwise similar to Examples 1 and 2, the pH value was increased to 1.7, which at the two temperatures indicated revealed both excellent adhesion and no sign of pitting corrosion.

EXAMPLE 4

A further increase in the pH value to 2.2 with parameters otherwise identical to the above Examples revealed at both temperature values (60° C. and 50° C.) a reduced adhesion of the zinc coating (determined by an Brichsen test).

EXAMPLE 5

The pH value of the electrolyte now amounted to 3.2, all other values corresponding to those of the first examples. The zinc coating could now be completely removed like a foil from the stainless steel strip.

EXAMPLE 6

The zinc-coating plant was now changed over to two-sides operation and a stainless steel strip of similar quality was now coated on both sides to a thickness of 7.5 μm in each case after an identical preliminary treatment on both sides. The current density amounted to 125 g/l. With both pH values of 1.2 and 1.7 the test pieces produced were trouble-free at 50° C. and 60° C. with excellent adhesion of the coating.

EXAMPLE 7

With a pH value of the electrolyte of 2.2 and a temperature of 50° C. the test pieces were likewise trouble-free.

EXAMPLE 8

With conditions otherwise identical to Examples 6 and 7, in the case of a pH value of 2.2 and a temperature now of 60° C. a reduced adhesion of the zinc coating to the carrier material was found.

EXAMPLE 9

After increasing the pH value to 3.2 both at 50° C. and at 60° C., reduced adhesion was established.

EXAMPLE 10

In addition, after a preliminary treatment identical to Example 1 a stainless steel strip of quality AISI 410 Cb was zinc-coated. As a surprising effect it was found that in the entire range covered by Examples 1 to 9 for the process parameters there was a reduced adhesion of the zinc coating.

EXAMPLE 11

The coated material from Example 10 was subjected to a thermal after-treatment. It was treated in an infrared furnace at 220° C. for a duration of 20 minutes, as a result of which it was possible to improve the adhesion of the coating to those values which were achieved with the cold strip of stainless ferrite steel in the case of the process parameters indicated in Example 4 or 7.

EXAMPLE 12

A thermal after-treatment was likewise performed with the sample produced from Example 8. The material was heated at 300° C. in an infrared furnace for a duration of approximately 1 to 5 minutes. After that there was an equally good adhesion of the zinc coating to the carrier material

We claim:

1. A process for the electrolytic zinc coating of stainless steel on at least one side of the steel, comprising the steps of:

a) connecting the stainless steel as a cathode in the form of a stainless steel strip in a galvanic cell; and b) depositing metallic zinc on the stainless steel strip from an aqueous solution of a zinc salt with a pH value of 1.0 to 2.5; and c) subjecting the deposited zinc coated stainless steel of step b) to a subsequent heat treatment carried out at a temperature in a range from 100° to 400° C. for a duration of 1 to 30 minutes.

2. The process according to claim 1, wherein the coating takes place at a constant current density.

3. The process according to claim 2, wherein the current densities are between 25 and 200 A/dm$^2$, for coating on one side of the steel, and between 10 and 100 A/dm$^2$, for coating on both sides of the steel.

4. The process of claim 2, wherein the current densities are between 50 and 150 A/dm$^2$ for coating on one side of the steel.

5. The process of claim 2, wherein the current densities are between 25 and 75 A/dm$^2$ for coating on both sides of the steel.

6. The process according to claim 1, wherein the zinc salt is present as zinc sulphate, the concentration of dissolved zinc ions in the solution amounting to 20 to 150 g/l.

7. The process of claim 1, wherein the concentration of dissolved zinc ions in the solution amounting to 100 to 130 g/l.

8. The process according to claim 1, wherein the temperature of the electrolyte is in a range from 20° to 90° C.

9. The process of claim 1, wherein the temperatures of the electrolyte is in a range from 45° to 60° C.

10. The process according to claim 1, wherein the anodes used are in the form of insoluble anodes selected from the group consisting of lead, a lead alloy and titanium coated with noble metals.

11. The process of claim 1, wherein the pH value is in the range of 1.5 to 2.0.

12. The process of claim 1, wherein the subsequent heat treatment is carried out at a temperature in a range from 200° to 300° C.

* * * * *